US009709010B2

(12) United States Patent
Kato

(10) Patent No.: US 9,709,010 B2
(45) Date of Patent: Jul. 18, 2017

(54) FUEL INJECTION VALVE

(71) Applicant: DENSO CORPORATION, Kariya, Aichi-pref. (JP)

(72) Inventor: Noritsugu Kato, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/121,160

(22) PCT Filed: Jan. 29, 2015

(86) PCT No.: PCT/JP2015/000394
§ 371 (c)(1),
(2) Date: Aug. 24, 2016

(87) PCT Pub. No.: WO2015/194071
PCT Pub. Date: Dec. 23, 2015

(65) Prior Publication Data

US 2017/0009717 A1 Jan. 12, 2017

(30) Foreign Application Priority Data

Jun. 16, 2014 (JP) ..... 2014-123281

(51) Int. Cl.
*F02M 51/06* (2006.01)
*F02M 61/18* (2006.01)

(52) U.S. Cl.
CPC ..... *F02M 51/06* (2013.01); *F02M 61/1813* (2013.01); *F02M 61/1846* (2013.01); *F02M 51/0685* (2013.01)

(58) Field of Classification Search
CPC .. F02M 51/06; F02M 51/061; F02M 51/0625; F02M 51/0664; F02M 61/18; F02M 61/1813; F02M 61/1826; F02M 61/1833; F02M 61/1846
See application file for complete search history.

(56) References Cited

U.S. PATENT DOCUMENTS 4,771,948 A * 9/1988 Furukawa ..... F02M 51/0675 239/533.12
5,540,200 A * 7/1996 Naitoh ..... F02M 51/065 123/299
5,819,707 A * 10/1998 Grytz ..... F02M 61/1853 123/432
6,439,484 B2 * 8/2002 Harata ..... F02M 51/0614 239/552

(Continued)

FOREIGN PATENT DOCUMENTS

JP 2004-019569 1/2004
JP 2006-207419 8/2006

(Continued)

*Primary Examiner* — Christopher Kim
(74) *Attorney, Agent, or Firm* — Nixon & Vanderhye PC

(57) ABSTRACT

Injection holes of an injection nozzle are respectively formed such that an inner diameter of an outer opening is larger than an inner diameter of an inner opening. Furthermore, the injection holes are formed such that when an imaginary plane, which includes a valve seat portion that is a portion of a valve seat and is adjacent to the injection hole, is extended toward a central axis, the imaginary plane first intersects with an injection hole inner wall portion of an injection hole inner wall of the injection hole.

4 Claims, 4 Drawing Sheets

(56) References Cited

U.S. PATENT DOCUMENTS 6,991,188 B2 * 1/2006 Kobayashi ..... B24B 15/04 239/494
7,159,802 B2 * 1/2007 Oomura ..... F02M 61/1853 239/533.12
RE40,199 E * 4/2008 Sugimoto ..... F02M 61/1806 239/533.12
7,726,590 B2 * 6/2010 Von Bacho, III .... F02M 61/168 239/533.12
8,002,207 B2 * 8/2011 Hashii ..... F02M 51/0682 239/533.12
8,083,160 B2 * 12/2011 Kato ..... F02M 51/0671 239/533.12
8,967,500 B2 * 3/2015 Hashii ..... F02M 51/0671 239/533.12
2004/0021014 A1 * 2/2004 Pilgram ..... F02M 51/0664 239/533.12
2006/0124774 A1 * 6/2006 Dantes ..... F02M 61/12 239/585.1
2006/0226264 A1 * 10/2006 Bacho ..... F02M 61/1853 239/533.12
2007/0000476 A1 1/2007 Mizobuchi et al.
2007/0012805 A1 * 1/2007 Maier ..... F02M 51/0671 239/533.12
2007/0095952 A1 * 5/2007 Heinstein ..... F02M 51/0671 239/585.1
2008/0196691 A1 8/2008 Kihara et al.
2008/0210198 A1 9/2008 Yamada et al.
2009/0283612 A1 11/2009 Grant et al.
2012/0305674 A1 12/2012 Buehner et al.
2015/0129687 A1 * 5/2015 Kaneta ..... F02M 61/1833 239/585.5
2017/0082077 A1 * 3/2017 Kato ..... F02M 51/06

FOREIGN PATENT DOCUMENTS

JP 2007-085333 4/2007
JP 2010-151053 7/2010
JP 2011-169281 9/2011
JP 2012-246897 12/2012

* cited by examiner

FUEL INJECTION VALVE

This application is the U.S. national phase of international Application No. PCT/JP2015/000394, filed Jan. 29, 2015, which designated the U.S. and claims priority to Japanese Patent Application No. 2014-123281 filed on Jun. 16, 2014, the entire contents of each of which are hereby incorporated by reference.

CROSS REFERENCE TO RELATED APPLICATION

The present application is based on and incorporates herein by reference Japanese Patent Application No. 2014-123281 filed on Jun. 16, 2014.

TECHNICAL FIELD

The present disclosure relates to a fuel injection valve that injects fuel in an internal combustion engine (hereinafter referred to as an engine).

BACKGROUND ART

Previously, there is a known fuel injection valve that opens and closes injection holes formed in a housing through reciprocation of a needle to inject fuel, which is placed in the housing. For example, the patent literature 1 recites a fuel injection valve that includes a housing, which includes a plurality of injection holes having different inner diameters that are set depending on an installation location of a spark plug relative to an internal combustion engine.

In the fuel injection valve of the patent literature 1, the injection holes are respectively formed such that an inner diameter of an inner opening of the injection hole formed in an inner wall of the housing is equal to an inner diameter of an outer opening of the injection hole formed in an outer wall of the housing, and a cross sectional area of the injection hole is constant from the inner opening to the outer opening. In general, in the injection hole, which is formed such that the cross sectional area of the injection hole is constant from the inner opening to the outer opening, a distance (hereinafter referred to as a spray penetration length) from the injection hole to a location where the fuel injected from the injection hole reaches is determined based on a ratio between the inner diameter of the injection hole and a wall thickness of a member, in which the injection holes are formed. Therefore, in the fuel injection valve of the patent literature 1, when the spray penetration length needs to be adjusted at the respective injection holes, a process, which changes the wall thickness in conformity with the respective injection holes, is required. Furthermore, when the inner diameter of the inner opening of the injection hole is reduced for the purpose of atomizing the fuel, the ratio between the inner diameter of the injection hole and the wall thickness is increased to cause an increase in the spray penetration length. Therefore, there is a high possibility of that the injected fuel collides against a piston and/or a cylinder block, which forms a combustion chamber, to cause an increase in the amount of particulate matter generated.

CITATION LIST

Patent Literature

Patent Literature 1: JP2007-085333A

SUMMARY OF THE INVENTION

It is an objective of the present disclosure to provide a fuel injection valve that can reduce the number of manufacturing steps of the fuel injection valve and can also reduce the amount of particulate matter generated at the time of combusting fuel.

In order to address the above objective, according to the present disclosure, there is provided a fuel injection valve that includes a housing, a needle, a coil, a stationary core and a movable core. The housing is shaped into a tubular form and includes: a plurality of injection holes, which are formed at one end of the housing in a direction of a central axis of the housing to inject fuel; a valve seat, which is formed around the plurality of injection holes; and a fuel passage, which conducts the fuel to be supplied to the plurality of injection holes. The needle is received in the housing in such a manner that the needle is reciprocatable in the direction of the central axis. The needle opens or closes the plurality of injection holes when the needle is lifted away from or is seated against the valve seat, respectively. The coil generates a magnetic field when the coil is energized. The stationary core is fixed in the housing at a location, which is within the magnetic field generated by the coil. The movable core is placed on a side of the stationary core, at which the valve seat is placed, in such a manner that the movable core is reciprocatable in the direction of the central axis of the housing. The movable core is attracted toward the stationary core when the coil is energized. An inner diameter of an outer opening of each of the plurality of injection holes, which is formed in an outer wall of the housing, is larger than an inner diameter of an inner opening of the injection hole, which is formed in an inner wall of the housing. The valve seat and each of the plurality of injection holes are formed such that when an imaginary plane, which includes the valve seat, is extended toward the central axis of the housing, the imaginary plane first intersects with an injection hole inner wall formed between the outer opening and the inner opening of the injection hole while the injection hole inner wall is formed such that a cross-sectional area of the injection hole increases from the inner opening toward the outer opening. An injection angle of each of the plurality of injection holes is defined as an angle between the central axis of the housing and an injection hole axis of the injection hole that extends through both of an inner wall side center point of the injection hole, which is placed on the inner wall of the housing, and a point, which is located along the central axis of the housing, and each of the plurality of injection holes is formed such that the smaller the injection angle of the injection hole is, the smaller the inner diameter of the inner opening of the injection hole is.

In the fuel injection valve of the present disclosure, the injection hole is formed such that the inner diameter of the outer opening of the injection hole, which is formed in the outer wall of the housing, is larger than the inner diameter of the inner opening of the injection hole, which is formed in the inner wall of the housing, and the injection hole inner wall, which is formed between the outer opening and the inner opening of the injection hole, increases the cross-sectional area of the injection hole from the inner opening toward the outer opening.

The inventor of the present application has found the following result through experiments. That is, in comparison to the injection hole that has the injection hole inner wall having the constant cross sectional area from the inner opening to the outer opening of the injection hole, when the injection hole has the injection hole inner wall that is formed in such a manner that the cross-sectional area of the injection hole is increased from the inner opening toward the outer opening, a spray penetration length does not substantially change even when a ratio of the wall thickness relative to the inner diameter of the inner opening of the injection hole changes. Thereby, even when the inner diameter of the inner opening of the injection hole is changed in response to the injection state of the fuel that is injected through the respective injection holes, it does not have an influence on the spray penetration length. Therefore, it is not required to have a process that adjusts the thickness of the portion of the housing, in which the injection holes are formed. In this way, the number of the manufacturing steps can be reduced.

Furthermore, in the fuel injection valve of the present disclosure, the valve seat is formed such that when the imaginary plane, which includes the valve seat (more specifically, a valve seat portion that is a portion of the valve seat), is extended toward the central axis, the imaginary plane first intersects with the injection hole inner wall (more specifically, an injection hole inner wall portion that is a portion of the injection hole inner wall), which forms the injection hole. At the time of lifting the needle away from the valve seat, the fuel, which flows along the surface of the valve seat (the valve seat portion) toward the injection hole, collides against the injection hole inner wall (the injection hole inner wall portion) without colliding against the other portion of the housing. The fuel, which collides against the injection hole inner wall (the injection hole inner wall portion), flows along the injection hole inner wall (the injection hole inner wall portion) while maintaining the pressure of the fuel that flows in the fuel passage. Therefore, the fuel can be easily atomized.

Furthermore, when the spray penetration length is increased to cause collision of the fuel against the piston and/or the cylinder block, the amount of particulate matter generated may possibly be increased. When the injection angle of the injection hole is reduced, a collision angle defined between the imaginary plane, which includes the valve seat (the valve seat portion), and the injection hole inner wall (the injection hole inner wall portion) of the injection hole is reduced. Thus, although a flow speed of the fuel, which flows along the injection hole inner wall (the injection hole inner wall portion), is increased, the urging force, which urges the fuel against the injection hole inner wall (the injection hole inner wall portion), is reduced. Therefore, the atomization of the fuel becomes difficult.

In view of the above point, in the fuel injection valve of the present disclosure, the inner diameter of the inner opening of the injection hole, which has the smaller injection angle, is set to be smaller than the inner diameter of the inner opening of the injection hole, which has the larger injection angle in comparison to the smaller injection angle of the aforementioned injection hole. In this way, the flow speed of the fuel, which flows along the injection hole inner wall (the injection hole inner wall portion), is further increased, so that the atomization of the fuel is further promoted.

Furthermore, the inventor of the present application has found through the experiments that when the inner diameter of the inner opening of the injection hole is reduced, the fuel is atomized to reduce the spray penetration length. Thereby, even when the fuel, which has the high flow speed, is injected from the injection hole that has the smaller injection angle, it is possible to limit an increase in the amount of particulate matter generated upon collision of the fuel against the piston and/or the cylinder block.

As discussed above, in the fuel injection valve of the present disclosure, the injection hole inner wall of the injection hole has the cross section that is progressively increased from the inner opening toward the outer opening, and the number of steps for processing the thickness of the wall of the portion, which forms the injection hole, is reduced in conformity with the spray penetration length. Furthermore, the injection hole is formed such that the smaller the injection angle of the injection hole is, the smaller the inner diameter of the inner opening of the injection hole, and the injection hole inner wall (the injection hole inner wall portion) crosses the imaginary plane, which includes the valve seat (the valve seat portion). Thereby, the atomization of the fuel, which is injected from the injection hole, is promoted. Furthermore, the collision of the fuel against the piston and/or the cylinder block is limited to limit the generation of the particulate matter. Thus, the fuel injection valve of the present disclosure can eliminate a need for the adjusting process for adjusting the thickness of the wall of the portion, which forms the injection hole, to adjust the spray penetration length, and the fuel injection valve of the present disclosure can reduce the spray penetration length while atomizing the fuel to reduce the amount of particulate matter generated.

DESCRIPTION OF EMBODIMENTS

An embodiment of the present disclosure will be described with reference to the accompanying drawings.

Figure 1:
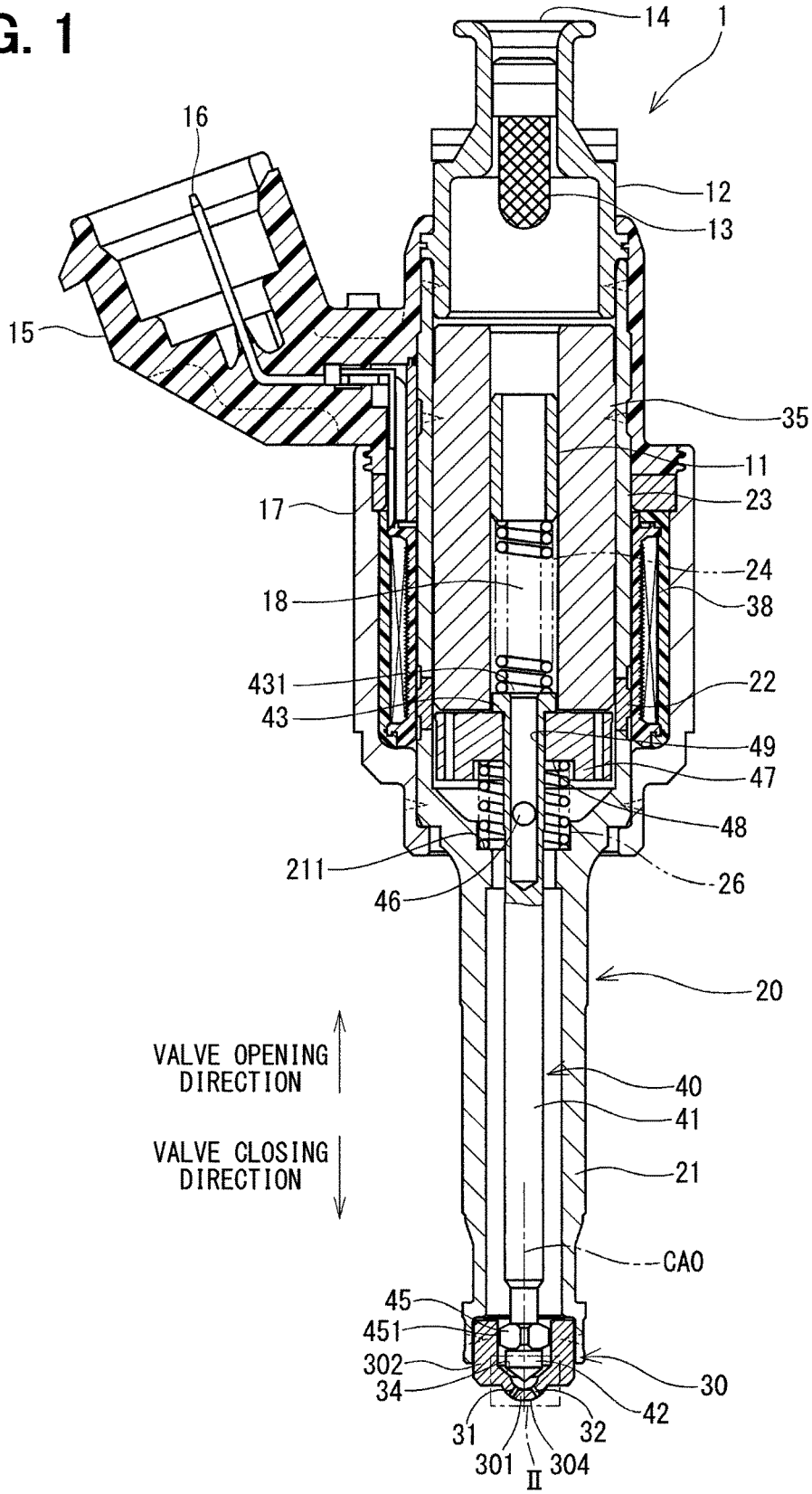
FIG. 1 is a cross sectional view of a fuel injection valve according to an embodiment of the present disclosure.
Figure 2:
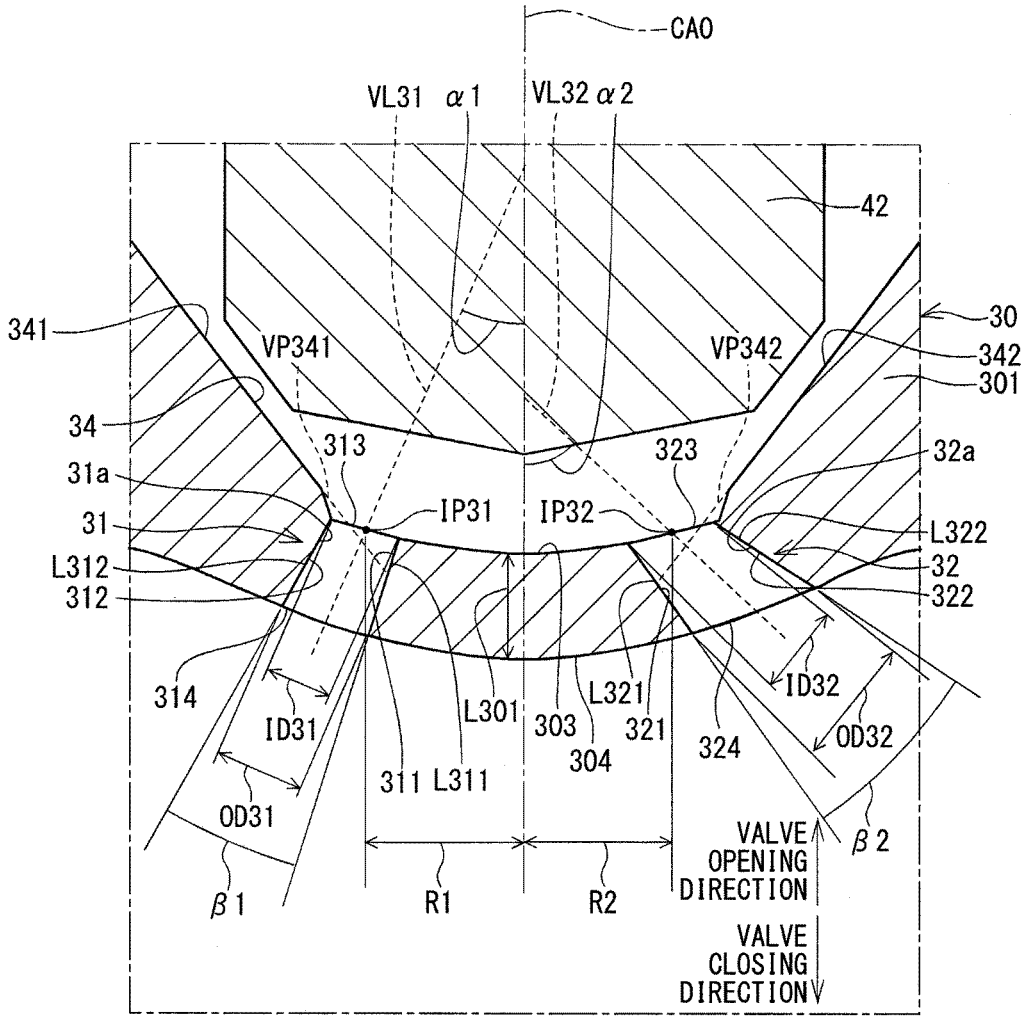
FIG. 2 is an enlarged view of a portion II in FIG. 1.

FIGS. 1 and 2 show a fuel injection valve 1 according to an embodiment of the present disclosure. A valve opening direction, which is a direction of lifting a needle 40 away from a valve seat 34, and a valve closing direction, which is a direction of seating the needle 40 against the valve seat 34, are shown in FIGS. 1 and 2.

The fuel injection valve 1 is used in a fuel injection device of, for example, a direct-injection gasoline engine (not shown) and injects gasoline, which serves as fuel, into the engine at a high pressure. The fuel injection valve 1 includes a housing 20, the needle 40, a movable core 47, a stationary core 35, a coil 38 and springs 24, 26.

As shown in FIG. 1, the housing 20 includes a first tubular member 21, a second tubular member 22, a third tubular member 23 and an injection nozzle 30. The first tubular member 21, the second tubular member 22 and the third tubular member 23 are respectively shaped into a generally cylindrical tubular form, and the first tubular member 21, the second tubular member 22 and the third tubular member 23 are coaxially arranged one after another in this order and are joined one after another.

The first tubular member 21 and the third tubular member 23 are made of a magnetic material, such as ferritic stainless steel, and are treated through a magnetic-stabilization process. The hardness of the first tubular member 21 and the third tubular member 23 is relatively low. In contrast, the second tubular member 22 is made of a non-magnetic material, such as austenitic stainless steel. The hardness of the second tubular member 22 is higher than the hardness of the first tubular member 21 and the third tubular member 23.

The injection nozzle 30 is installed to an end portion of the first tubular member 21, which is opposite from the second tubular member 22. The injection nozzle 30 is shaped into a tubular form having a bottom and is made of metal, such as martensitic stainless steel. The injection nozzle 30 is welded to the first tubular member 21. The injection nozzle 30 is quenched to have predetermined hardness. The injection nozzle 30 has an injecting portion 301 and a tubular portion 302.

The injecting portion 301 is shaped into a spherical shell form that is centered at a point along a central axis CAO of the housing 20 that is coaxial with a central axis of the fuel injection valve 1. An outer wall 304 of the injecting portion 301 projects in a direction of the central axis CAO. A plurality of injection holes is formed in the injecting portion 301 to communicate between an inside and an outside of the housing 20. At an inner wall 303 of the injecting portion 301, the valve seat 34, which is shaped into an annular form, is formed at an outer periphery of inner openings, which are openings of the injection holes formed in the inner wall 303. Details of the structure of the injection nozzle 30 will be described later.

The tubular portion 302 surrounds a radially outer side of the injecting portion 301 and extends toward an opposite side that is opposite from a projecting direction of the outer wall 304 of the injecting portion 301. One end part of the tubular portion 302 is joined to the injecting portion 301, and another end part of the tubular portion 302 is joined to the first tubular member 21.

The needle 40 is made of metal, such as martensitic stainless steel. The needle 40 is quenched to have predetermined hardness. The hardness of the needle 40 is generally equal to the hardness of the injection nozzle 30.

The needle 40 is received in an inside of the housing 20 such that the needle 40 is reciprocatable in the housing 20. The needle 40 includes a shaft portion 41, a seal portion 42 and a large diameter portion 43. The shaft portion 41, the seal portion 42 and the large diameter portion 43 are integrally formed as a one-piece component.

The shaft portion 41 is shaped into a cylindrical tubular rod form. A slidable portion 45 is formed at a part of the shaft portion 41, which is adjacent to the seal portion 42. The slidable portion 45 is shaped into a generally cylindrical tubular form, and a portion of an outer wall 451 of the slidable portion 45 is chamfered. A portion of the outer wall 451, which is not chamfered, is slidably contactable with the inner wall of the injection nozzle 30. In this way, reciprocation of a distal end portion of the needle 40, which is located at the valve seat 34 side, is guided. A hole 46 is formed in the shaft portion 41 to communicate between an inner wall and an outer wall of the shaft portion 41.

The seal portion 42 is formed at the distal end portion of the shaft portion 41, which is located at the valve seat 34 side, such that the seal portion 42 is contactable with the valve seat 34. When the seal portion 42 of the needle 40 is lifted from and seated against the valve seat 34, the needle 40 opens and closes the injection holes to communicate and discommunicate between the inside and the outside of the housing 20.

The large diameter portion 43 is formed at an opposite side of the shaft portion 41, which is opposite from the seal portion 42. The large diameter portion 43 is formed such that an outer diameter of the large diameter portion 43 is larger than an outer diameter of the shaft portion 41. An end surface of the large diameter portion 43, which is located at the valve seat 34 side, contacts the movable core 47.

The slidable portion 45 of the needle 40 is supported by the inner wall of the injection nozzle 30. The shaft portion 41 of the needle 40 reciprocates in the inside of the housing 20 while the shaft portion 41 is supported by the inner wall of the second tubular member 22 through the movable core 47.

The movable core 47 is shaped into a generally cylindrical tubular form and is made of a magnetic material, such as ferritic stainless steel. Furthermore, a surface of the movable core 47 is chrome plated. The movable core 47 is treated through a magnetic-stabilization process. The hardness of the movable core 47 is generally equal to the hardness of the first tubular member 21 and the third tubular member 23 of the housing 20. A through-hole 49 is formed to extend though generally a center of the movable core 47. The shaft portion 41 of the needle 40 is inserted through the through-hole 49.

The stationary core 35 is shaped into a generally cylindrical tubular form and is made of a magnetic material, such as ferritic stainless steel. The stationary core 35 is treated through a magnetic-stabilization process. The hardness of the stationary core 35 is generally equal to the hardness of the movable core 47. However, in order to ensure the function of the stationary core 35 as a stopper for stopping the movement of the movable core 47, a surface of the stationary core 35 is chrome plated, and thereby a required hardness of the stationary core 35 is ensured. The stationary core 35 is welded to the third tubular member 23 of the housing 20, so that the stationary core 35 is fixed to an inside of the housing 20.

The coil 38 is shaped into a generally cylindrical tubular form and is arranged to surround a radially outer side of the second tubular member 22 and the third tubular member 23. The coil 38 generates a magnetic field when the electric power is supplied to the coil 38. When the magnetic field is generated around the coil 38, a magnetic circuit is formed in the stationary core 35, the movable core 47, the first tubular member 21 and the third tubular member 23. In this way, a magnetic attractive force is generated between the stationary core 35 and the movable core 47, so that the movable core 47 is attracted to the stationary core 35. At this time, the needle 40, which contacts an opposite surface of the movable core 47 that is opposite from the valve seat 34, is moved toward the stationary core 35, i.e., is moved in the valve opening direction.

The spring 24 is arranged such that one end of the spring 24 contacts a spring contact surface 431 of the large diameter portion 43. The other end of the spring 24 contacts one end of an adjusting pipe 11, which is securely press fitted to the inside of the stationary core 35. The spring 24 has an expansion force for expanding in the axial direction. Thereby, the spring 24 urges the needle 40 together with the movable core 47 toward the valve seat 34, i.e., in the valve closing direction.

The spring 26 is set such that one end of the spring 26 contacts a step surface 48 of the movable core 47. The other end of the spring 26 contacts a step surface 211, which is shaped into an annular form and is formed in an inner wall of the first tubular member 21 of the housing 20. The spring 26 has an expansion force for expanding in the axial direction. In this way, the spring 26 urges the movable core 47 together with the needle 40 in a direction that is opposite from the valve seat 34, i.e., in the valve opening direction.

In the present embodiment, the urging force of the spring 24 is set to be larger than the urging force of the spring 26. In this way, in the state where the electric power is not supplied to the coil 38, the seal portion 42 of the needle 40 is placed into a seated state where the seal portion 42 is seated against the valve seat 34, i.e., the seal portion 42 of the needle 40 is placed into a valve closing state.

A fuel inlet pipe 12, which is shaped into a generally cylindrical tubular form, is press fitted into and is welded to an end portion of the third tubular member 23, which is opposite from the second tubular member 22. A filter 13 is installed in an inside of the fuel inlet pipe 12. The filter 13 captures foreign objects contained in the fuel introduced through an inlet 14 of the fuel inlet pipe 12.

A radially outer side of the fuel inlet pipe 12 and the third tubular member 23 are insert molded with resin. A connector 15 is formed in this molded portion. Terminals 16 for supplying the electric power to the coil 38 are insert molded in the connector 15. A holder 17, which is shaped into a tubular form, is formed on a radially outer side of the coil 38 such that the holder 17 covers the coil 38.

The fuel, which is introduced from the inlet 14 of the fuel inlet pipe 12, is guided into the inside of the injection nozzle 30 through the radially inner side of the stationary core 35, the inside of the adjusting pipe 11, the inside of the large diameter portion 43 and the shaft portion 41 of the needle 40, the hole 46 and the gap between the first tubular member 21 and the shaft portion 41 of the needle 40. That is, a passage, which is from the inlet 14 of the fuel inlet pipe 12 to the gap between the first tubular member 21 and the shaft portion 41 of the needle 40, forms a fuel passage 18 that introduces the fuel into the inside of the injection nozzle 30. In the fuel injection valve of the present embodiment, a pressure of the fuel, which flows in the fuel passage 18, is set to be equal to or higher than 1 MPa.

The fuel injection valve 1 of the present embodiment is characterized by the location of the injection holes and the configuration of the injection holes. The location and the configuration of the injection holes will be described with reference to FIG. 2, which is a cross sectional view of the fuel injection valve 1 taken along a central axis CAO.

First of all, the configuration of the injection hole 31 will be described.

The injection hole 31 is formed such that an angle, which is defined between an imaginary line VL31 (serving as an injection hole axis) and the central axis CAO, forms an injection angle $\alpha 1$ of the injection hole 31. Here, the imaginary line VL31 extends through an inner wall side center point IP31, which is located along the inner wall 303 of the injecting portion 301 and is spaced from the central axis CAO by a predetermined distance R1, and a point along the central axis CAO.

Furthermore, the injection hole 31 is formed such that a cross section of the injection hole 31, which is perpendicular to the imaginary line VL31, is a circle. An inner diameter OD31 of an outer opening 314 of the injection hole 31, which is formed in the outer wall 304, is larger than an inner diameter ID31 of an inner opening 313 of the injection hole 31, which is formed in the inner wall 303. That is, in a view taken from the outside of the fuel injection valve 1, the injection hole 31 is tapered such that the inner diameter of the injection hole 31 is progressively reduced toward the inside of the injection nozzle 30.

The injection hole 31 is formed such that an injection hole inner wall 31*a*, which has a cross section that is progressively increased from the inner opening 313 toward the outer opening 314, defines an open angle $\beta 31$.

The open angle $\beta 1$ will be specifically described with reference to FIG. 2, which is the cross sectional view of the fuel injection valve 1 that extends along the central axis CAO and the imaginary line VL31. Here, for the sake of convenience, a portion of the injection hole inner wall 31*a* of the injection hole 31, which is located on the central axis CAO side of the imaginary line VL31, will be referred to as an injection hole inner wall portion 311. Furthermore, another portion of the injection hole inner wall 31*a* of the injection hole 31, which is located on an opposite side of the imaginary line VL31 that is opposite from the central axis CAO, will be referred to as an injection hole inner wall portion 312 (serving as an injection hole inner wall portion that is located on an opposite side of the injection hole axis, which is opposite from the injection hole inner wall portion where one straight line is positioned). With reference to FIG. 2, an angle, which is defined between a cross sectional line L311 (serving as "the one straight line") located along the injection hole inner wall portion 311 and a cross sectional line L312 (serving as "another straight line") located along the injection hole inner wall portion 312, is defined as the open angle $\beta 1$. In other words, the open angle $\beta 1$ of the injection hole 31 is an angle defined between the cross sectional line (the one straight line) L311, which is located along the injection hole inner wall 31*a* and connects between the outer opening 314 and the inner opening 313, and the cross sectional line (the another straight line) L312, which is located along the injection hole inner wall 31*a* on the opposite side of the injection hole axis VL31 with respect to the cross sectional line (the one straight line) L311 and connects between the outer opening 314 and the inner opening 313. In the present embodiment, the open angle $\beta 1$ of the injection hole 31 is set to be in a range of 10° to 22°.

A valve seat portion 341, which is a portion of the valve seat 34 and is located on an opposite side of the injection hole 31, which is opposite from the central axis CAO, is formed such that when an imaginary plane VP341, which includes the valve seat portion 341, is extended toward the central axis CAO, the imaginary plane VP341 first intersects with the injection hole inner wall portion 311. The valve seat portion 341 is a portion of the valve seat 34, which is located on an upstream side of the injection hole 31 and is adjacent to the injection hole 31.

Next, the configuration of the injection hole 32 will be described.

The injection hole 32 is formed such that an angle, which is defined between an imaginary line VL32 (serving as an injection hole axis) and the central axis CAO, forms an injection angle $\alpha 2$ of the injection hole 32, which is larger than the injection angle $\alpha 1$. Here, the imaginary line VL32 extends through an inner wall side center point IP32, which is located along the inner wall 303 of the injecting portion 301 and is spaced from the central axis CAO by a predetermined distance R2, and a point along the central axis CAO.

Furthermore, the injection hole 32 is formed such that a cross section of the injection hole 32, which is perpendicular to the imaginary line VL32, is a circle. An inner diameter OD32 of the outer opening 324, which is formed in the outer wall 304, is larger than an inner diameter ID32 of the inner opening 323, which is formed in the inner wall 303. That is, the injection hole 32 is tapered such that the inner diameter of the injection hole 32 is progressively reduced toward the inside of the injection nozzle 30.

The inner diameter ID32 is larger than the inner diameter ID31.

The injection hole 32 is formed such that an injection hole inner wall 32*a*, which has a cross section that is progressively increased from the inner opening 323 toward the outer opening 324, defines an open angle β2.

The open angle β2 will be specifically described with reference to FIG. 2, which is the cross sectional view of the fuel injection valve 1 that extends along the central axis CAO and the imaginary line VL32. Here, for the sake of convenience, a portion of the injection hole inner wall 32*a* of the injection hole 32, which is located on the central axis CAO side of the imaginary line VL32, will be referred to as an injection hole inner wall portion 321. Furthermore, another portion of the injection hole inner wall 32*a* of the injection hole 32, which is located on an opposite side of the imaginary line VL32, which is opposite from the central axis CAO, will be referred to as an injection hole inner wall portion 322 (serving as an injection hole inner wall portion that is located on an opposite side of the injection hole axis, which is opposite from the injection hole inner wall portion where one straight line is positioned). With reference to FIG. 2, an angle, which is defined between a cross sectional line L321 (serving as "the one straight line") located along the injection hole inner wall portion 321 and a cross sectional line L322 (serving as "another straight line") located along the injection hole inner wall portion 322, is defined as the open angle β2. In the present embodiment, the open angle β2 of the injection hole 32 is set to be in the range of 10° to 22°.

A valve seat portion 342, which is a portion of the valve seat 34 and is located on an opposite side of the injection hole 32, which is opposite from the central axis CAO, is formed such that when an imaginary plane VP342, which includes the valve seat portion 342, is extended toward the central axis CAO, the imaginary plane VP342 first intersects with the injection hole inner wall portion 321 of the injection hole 32.

Here, although the size relationship between the injection angle and the inner diameter of the inner opening, the size relationship between the inner diameter of the inner opening and the inner diameter of the outer opening of the injection hole, the size of the open angle, and the positional relationship between the valve seat and the injection hole inner wall have been described only for the two injection holes 31, 32 shown in FIG. 2, the other injection holes of the injection nozzle 30, which are other than the injection holes 31, 32 have the above described relationships.

That is, in the fuel injection valve 1 of the present embodiment, all of the injection holes are configured such that the inner diameter of the outer opening is larger than the inner diameter of the inner opening, and the injection hole inner wall is shaped to progressively increase the cross sectional area of the injection hole from the inner opening toward the outer opening. Furthermore, among the injection holes, each of the injection hole(s), which has a smaller injection angle in comparison to the other injection hole(s), also has a smaller inner diameter of the inner opening in comparison to the other injection hole(s). Furthermore, in the fuel injection valve 1 of the present embodiment, when the imaginary plane, which includes the valve seat (the valve seat portion), is extended toward the central axis, the imaginary plane first intersects with the injection hole inner wall (the injection hole inner wall portion), and the open angle of the injection hole is in the range of 10° to 22°.

Experimental Result No. 1

Figure 3:
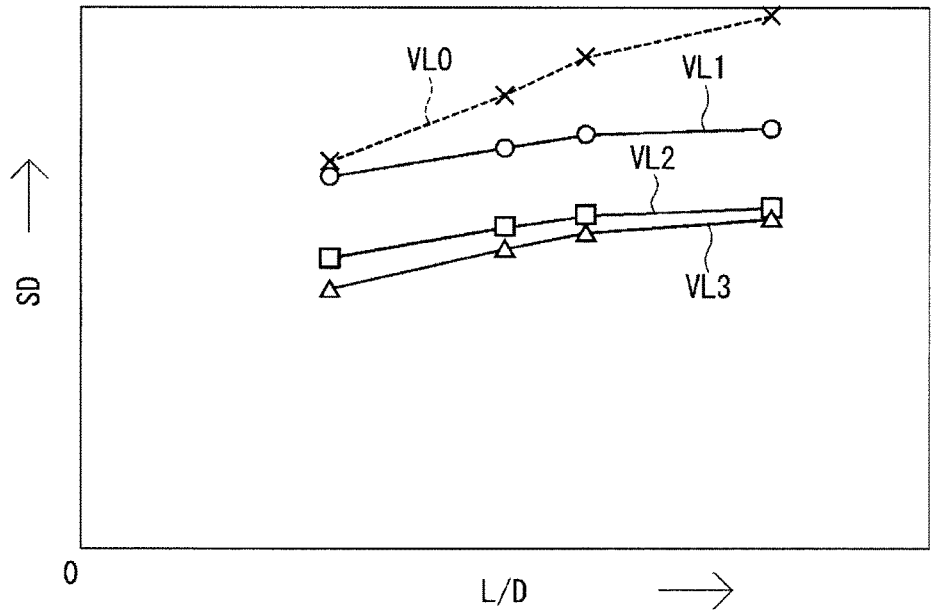
FIG. 3 is a characteristic diagram indicating a change in a spray penetration length relative to a ratio between an inner diameter of an inner opening of an injection hole and a wall thickness of an injecting portion in the fuel injection valve.

The inventor of the present application has conducted experiments with respect to a change in a spray penetration length relative to a change in a ratio between the inner diameter of the inner opening of the injection hole and a wall thickness of the portion where the injection hole is formed. FIG. 3 indicates the experimental results. In FIG. 3, an axis of abscissas indicates a ratio L/D between the inner diameter of the inner opening of the injection hole and the wall thickness of the portion where the injection hole is formed (corresponding to the wall thickness L301 of FIG. 2), and an axis of ordinate indicates the spray penetration length SD, which is the distance from the injection hole to the location where the fuel injected from the injection hole reaches. FIG. 3 indicates the experimental results of three different injection holes that respectively have different inner diameters at the inner openings of the injection holes while the injection hole inner wall of each of these three injection holes is configured such that the inner diameter of the inner opening is larger than the inner diameter of the outer opening, and the cross sectional area of the injection hole inner wall is progressively increased. Specifically, a sold line VL1 indicates an imaginary line, which connects the experimental results of the injection hole, which has the relatively large inner diameter at the inner opening. Furthermore, a solid line VL3 indicates an imaginary line, which connects the experimental results of the injection hole, which has the relatively small inner diameter at the inner opening. Also, a solid line VL2 indicates an imaginary line, which connects the experimental results of the injection hole, which has the intermediate inner diameter at the inner opening. Furthermore, in FIG. 3, as a comparative example, a dotted line VL0 indicates an imaginary line that connects experimental results of an injection hole, in which the inner diameter of the outer opening and the inner diameter of the inner opening are equal to each other, and the cross sectional area of the injection hole inner wall is contacts along the entire extent of the injection hole inner wall.

As shown in FIG. 3, the spray penetration length SD is increased when the ratio L/D is increased. At this time, the relationship between the ratio L/D and the spray penetration length SD in the respective injection holes that have the injection hole inner wall, which has the progressively increasing cross sectional area, shows a smaller change in the spray penetration length SD relative to the ratio L/D in comparison to the relationship between the ratio L/D and the spray penetration length SD in the injection hole of the fuel injection valve of the comparative example. That is, in comparison to the injection hole of the comparative example, the injection hole, which has the injection hole inner wall formed to have the progressively increasing cross sectional area, does not show a significant change in the spray penetration length SD even when the ratio L/D changes. Furthermore, FIG. 3 reveals that among the injection holes, each of which has the injection hole inner wall with the progressively increasing cross sectional area, the injection hole, which has the smaller inner diameter at the inner opening in comparison to the other injection hole(s), has the shorter spray penetration length in comparison to the other injection hole(s).

Experimental Result No. 2

The inventor of the present application has conducted experiments with respect to a relationship between the open angle of the injection hole and the spray penetration length.

Figure 4:
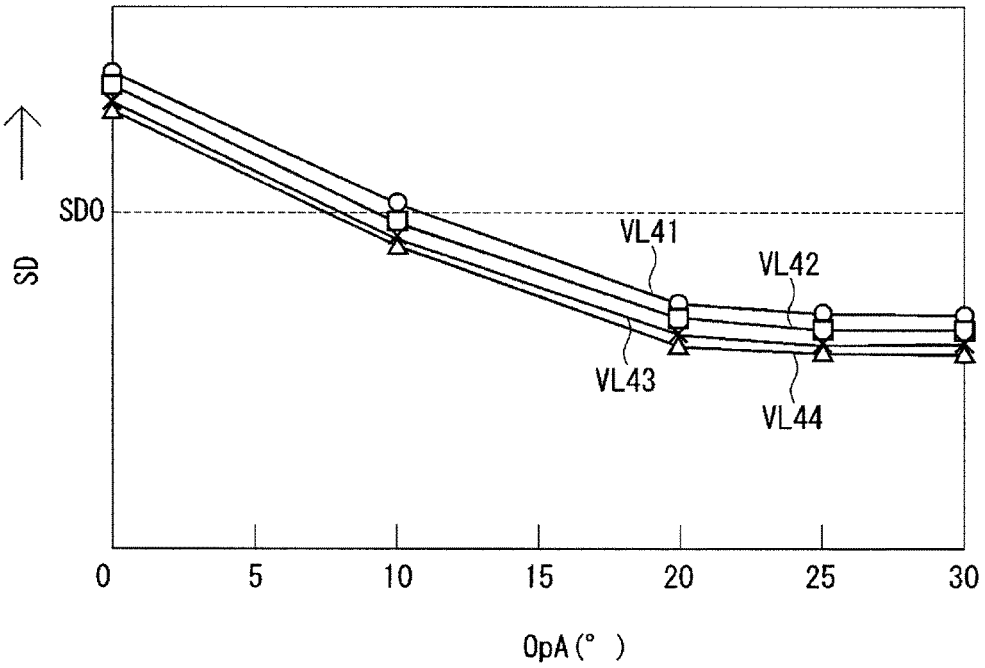
FIG. 4 is a characteristic diagram indicating a relationship between a taper angle and the spray penetration length at the fuel injection valve of the embodiment of the present disclosure.

FIG. 4 indicates the experimental results. In FIG. 4, an axis of abscissas indicates the open angle OpA, and an axis of ordinate indicates the spray penetration length SD. FIG. 4 indicates the spray penetration lengths SD at the open angles OpA of different injection angles. Specifically, the experimental results of the spray penetration lengths SD, which are respectively measured at the open angles of 0°, 10°, 20°, 25° and 30°, are plotted for each of the injection holes that respectively have the injection angles of 0°, 20°, 40° and 45°. In FIG. 4, a solid line VL41 indicates an imaginary line, which connects the experimental results at the injection angle of 0°, and a solid line VL42 indicates an imaginary line, which connects the experimental results at the injection angle of 20°. Furthermore, a solid line VL43 indicates an imaginary line, which connects the experimental results at the injection angle of 40°, and a solid line VL44 indicates an imaginary line, which connects the experimental results at the injection angle of 45°. Furthermore, FIG. 4 indicates an upper limit value SD0 of the spray penetration length SD. The upper limit value SD0 of the spray penetration length SD refers to a spray penetration length, at which the fuel injected from the injection hole collides against the piston and/or the inner wall of the cylinder block, which forms the combustion chamber of the engine. Specifically, when the spray penetration length SD is increased beyond the upper limit value SD0, the injected fuel collides against the piston and/or the inner wall of the cylinder block, and thereby the amount of particulate matter generated is increased.

As shown in FIG. 4, in the case of the open angle of 0°, the spray penetration length SD becomes larger than the upper limit value SD0, and thereby the amount of particulate matter generated is increased. In contrast, it is understood that in the cases of the open angles of 10°, 20°, 25° and 30°, the spray penetration length SD becomes smaller than the upper limit value SD0.

Furthermore, there is no significant difference among the injection angles at each corresponding one of the open angles OpA. However, the spray penetration length SD is increased when the injection angle is increased.

Experimental Result No. 3

Figure 5:
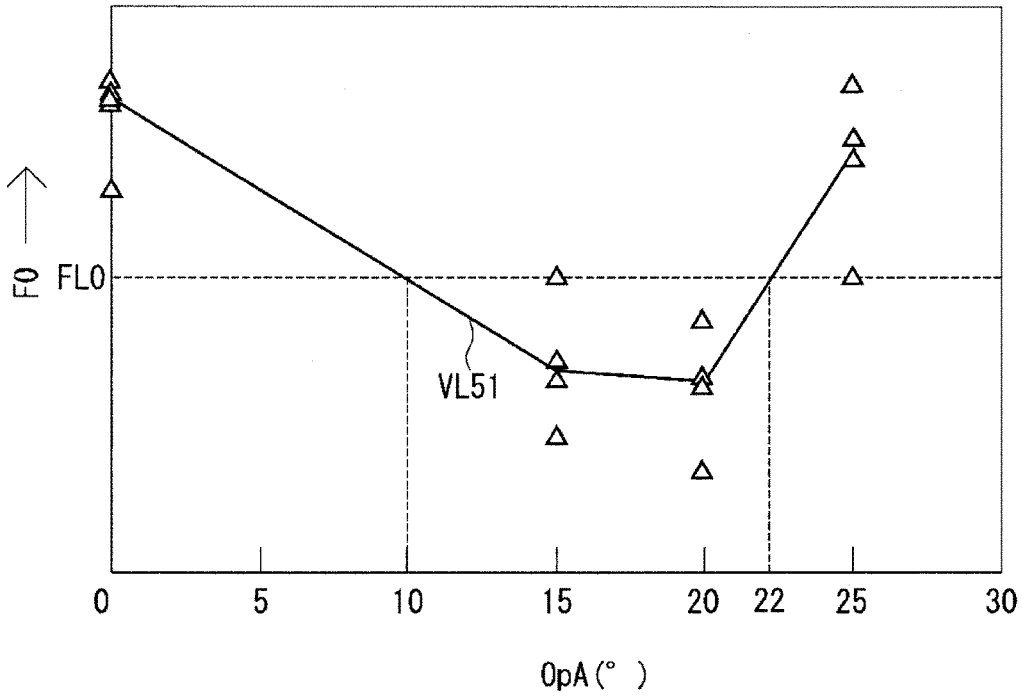
FIG. 5 is a characteristic diagram indicating a relationship between the taper angle and a flow rate reduction ratio at the fuel injection valve of the embodiment of the present disclosure.

The inventor of the present application has conducted experiments with respect to a relationship between the open angle of the injection hole and a flow rate reduction ratio for the fuel injection valve 1. FIG. 5 indicates the experimental results. In FIG. 5, an axis of abscissas indicates the open angle OpA of the injection hole, and an axis of ordinate indicates the flow rate reduction ratio F0. Here, "the flow rate reduction ratio F0" refers to a value that is obtained by dividing a value, which is computed by subtracting a flow rate of the fuel injected from the outer opening of the injection hole from a flow rate of the fuel inputted into the injection hole from the inner opening, by the flow rate of the fuel inputted into the injection hole from the inner opening. When the flow rate reduction ratio F0 is large, it indicates that a quantity of the fuel adhered to the outer wall of the portion, which forms the injection hole, is large. With respect to FIG. 5, the experiment is performed four times for each of the injection holes that respectively have open angles of 0°, 15°, 20° and 25°, and a solid line VL51 indicates an imaginary line that connects average values of the experimental results. Furthermore, FIG. 5 indicates a flow rate reduction ratio FL0 as an upper limit value of the flow rate reduction ratio F0.

In view of the relationship between the solid line VL51 and the flow rate reduction ratio FL0 shown in FIG. 5, it is understood that the flow rate reduction ratio F0 is reduced below the flow rate reduction ratio FL0 when the open angle of the injection hole is in the range of 10° to 22°. Based on the experimental results shown in FIG. 4, it is conceived that in the injection hole having the open angle of equal to or lager than 22°, at which the spray penetration length SD is relatively short, separation of the fuel from the wall of the injection hole is not effectively made, so that the quantity of the fuel adhered to the outer wall is increased, and thereby the flow rate reduction ratio F0 is increased beyond the flow rate reduction ratio FL0.

In the fuel injection valve 1 of the present embodiment, the injection hole 31 is formed such that the inner diameter OD31 of the outer opening 314 of the injection hole 31 is larger than the inner diameter ID31 of the inner opening 313 of the injection hole 31. Furthermore, the injection hole inner wall 31*a* of the injection hole 31 is formed such that the cross sectional area of the injection hole inner wall 31*a* is progressively increased.

When the injection hole inner wall is formed to have the progressively increasing cross sectional area, a change in the spray penetration length SD in response to a change in the ratio L/D is reduced in comparison to the case where the cross sectional area of the injection hole inner wall is constant from the inner opening to the outer opening of the injection hole, as indicated in FIG. 3. Thereby, the spray penetration length SD does not substantially change even when the ratio L/D is changed due to, for example, the settings of the flow rate of fuel conducted in the injection hole and/or the injection angle of the injection hole. Thus, it is not required to have a process of adjusting the wall thickness of the portion, in which the injection hole is formed, for the purpose of limiting the change in the spray penetration length. As a result, the number of manufacturing steps of the fuel injection valve 1 can be reduced.

Furthermore, in the fuel injection valve 1, the injection holes 31, 32 are formed such that the injection hole inner wall portion 311, 321 of the injection hole inner wall 31*a*, 32*a* located on the central axis CAO side intersects with the imaginary plane VP341, VP342, along which the valve seat portion 341, 342 is located. At the time of lifting the needle 40 away from the valve seat 34, the fuel, which flows along the surface of the valve seat portion 341, 342 toward the injection hole 31, 32, collides against the injection hole inner wall portion 311, 321 of the injection hole inner wall 31*a*, 32*a*, which forms the injection hole 31, 32, without colliding against the other portion of the housing 20. The fuel, which collides against the injection hole inner wall portion 311, 321, is pressed against the injection hole inner wall portion 311, 321 while maintaining the fuel pressure of the fuel passage 18. Thus, the fuel forms a liquid film on the injection hole inner wall portion 311, 321 while a gas phase is formed along the injection hole inner wall portion 312, 322. Thereby, the fuel can be easily atomized from the liquid film surface of the fuel. As a result, the atomization of the fuel is promoted, and thereby the amount of particulate matter generated can be reduced.

Furthermore, in the fuel injection valve 1, each of the injection holes is formed such that the smaller the injection angle of the injection hole is, the smaller the inner diameter of the inner opening of the injection hole is.

When the spray penetration length of the fuel injected from the injection hole is increased, the injected fuel collides against the piston and/or the cylinder block, which forms the combustion chamber. The combustion of the fuel, which collides against the piston and/or the cylinder block, tends to become incomplete, and thereby there is a high possibly of generating the particulate matter. When the injection angle of the injection hole is reduced, a collision angle defined between the imaginary plane, in which the valve seat portion is located, and the injection hole inner wall portion of the injection hole is reduced. Thus, the urging force, which urges the fuel against the injection hole inner wall portion, is reduced, and thereby the atomization of the fuel becomes difficult. In contrast, the flow speed of the fuel in the injection hole is increased, and thereby the spray penetration length tends to be increased. Therefore, the atomization of the fuel becomes difficult, and the spray penetration length is increased. As a result, the amount of particulate matter generated may possibly be increased.

In view of the above points, in the fuel injection valve 1 of the present embodiment, the inner diameter ID31 of the inner opening 313 of the injection hole 31, which has the injection angle $\alpha 1$ that is smaller than the injection angle $\alpha 2$, is reduced in comparison to the inner diameter ID32 of the inner opening 323 of the injection hole 32, which has the injection angle $\alpha 2$. In this way, as shown in FIG. 3, the spray penetration length becomes relatively small, so that the collision of the fuel against the piston and/or the cylinder block is limited. Furthermore, the flow speed of the fuel is further increased by reducing the inner diameter ID31 of the inner opening, and thereby the fuel can be more easily atomized. In this way, the fuel is atomized, and thereby it is possible to limit the increase in the amount of particulate matter caused by the collision of the fuel against the piston and/or the cylinder block.

Furthermore, in the fuel injection valve 1, the injection holes 31, 32 are formed to have the open angles $\beta 1$, $\beta 2$, respectively, which are in the range of 10° to 22°. As indicated in FIGS. 4 and 5, in the case where the open angle OpA of the injection hole is in this angular range, the spray penetration length SD can be appropriately shortened, and the flow rate reduction ratio F0 can be limited to the low rate. Thereby, the quantity of the fuel adhered to the outer wall 304 of the injecting portion 301 can be reduced, and the collision of the fuel injected from the injection hole against the piston and/or the cylinder block, which forms the combustion chamber, can be limited. Therefore, when the injection holes 31, 32 are formed such that the open angle $\beta 1$, $\beta 2$ is in the range of 10° to 22°, the amount of particulate matter generated can be further reduced.

Other Embodiments (A) In the above embodiment, the open angle of the injection hole is set to be in the range of 10° to 22°. However, the open angle of the injection hole should not be limited to this value. It is only required that the open angle of the injection hole is larger than 0°.

(B) In the above embodiment, the pressure of the fuel, which flows in the fuel passage, is set to be equal to or higher than 1 MPa. However, the pressure of the fuel should not be limited to this value. It is only required that the pressure of the fuel, which flows in the fuel passage, is a pressure that enables the injection of the fuel directly into the combustion chamber of the engine.

(C) In the above embodiment, the injection hole is formed such that the cross section of the injection hole is the circle. However, the shape of the cross section of the injection hole should not be limited to this shape.

The present disclosure should not be limited to the above embodiments, and the above embodiments may be modified in various ways within the principle of the present disclosure.

The invention claimed is:

1. A fuel injection valve comprising:

a housing that is shaped into a tubular form and includes:

a plurality of injection holes, which are formed at one end of the housing in a direction of a central axis of the housing to inject fuel;

a valve seat, which is formed around the plurality of injection holes; and a fuel passage, which conducts the fuel to be supplied to the plurality of injection holes;

a needle that is received in the housing in such a manner that the needle is reciprocatable in the direction of the central axis, wherein the needle opens or closes the plurality of injection holes when the needle is lifted away from or is seated against the valve seat, respectively;

a coil that generates a magnetic field when the coil is energized;

a stationary core that is fixed in the housing at a location, which is within the magnetic field generated by the coil; and a movable core that is placed on a side of the stationary core, at which the valve seat is placed, in such a manner that the movable core is reciprocatable in the direction of the central axis of the housing, wherein the movable core is attracted toward the stationary core when the coil is energized, wherein:

an inner diameter of an outer opening of each of the plurality of injection holes, which is formed in an outer wall of the housing, is larger than an inner diameter of an inner opening of the injection hole, which is formed in an inner wall of the housing;

the valve seat and each of the plurality of injection holes are formed such that when an imaginary plane, which includes the valve seat, is extended toward the central axis of the housing, the imaginary plane first intersects with an injection hole inner wall formed between the outer opening and the inner opening of the injection hole while the injection hole inner wall is formed such that a cross-sectional area of the injection hole increases from the inner opening toward the outer opening; and an injection angle of each of the plurality of injection holes is defined as an angle between the central axis of the housing and an injection hole axis the injection hole that extends through both of an inner wall side center point of the injection hole, which is placed on the inner wall of the housing, and a point, which is located along the central axis of the housing, and each of the plurality of injection holes is formed such that the smaller the injection angle of the injection hole is, the smaller the inner diameter of the inner opening of the injection hole is.

2. The fuel injection valve according to claim 1, wherein an open angle of each of the plurality of injection holes is in a range of 10 to 22°, and the open angle of each of the plurality of injection holes is an angle that is defined between:

one straight line, which extends between the outer opening and the inner opening along the injection hole inner wall; and another straight line, which extends between the outer opening and the inner opening along the injection hole inner wall and is located on an opposite side of the injection hole axis that is opposite to the one straight line.

3. The fuel injection valve according to claim 1, wherein a pressure of the fuel, which is injected from each of the plurality of injection holes, is equal to or larger than 1 MPa.

4. The fuel injection valve according to claim 1, wherein the injection angle of one of the plurality of injection holes is smaller than the injection angle of another one of the plurality of injection holes, and the inner diameter of the inner opening of the one of the plurality of injection holes is smaller than the inner diameter of the inner opening of the another one of the plurality of injection holes.

* * * * *